United States Patent [19]

Scheler

[11] Patent Number: 4,508,098

[45] Date of Patent: Apr. 2, 1985

[54] FIREPLACE CAP

[76] Inventor: Philip E. Scheler, Rte. 1, Western Heights, #12, Baker, Oreg. 97814

[21] Appl. No.: 452,025

[22] Filed: Dec. 21, 1982

[51] Int. Cl.[3] ..... F24C 15/04

[52] U.S. Cl. ..... 126/139; 126/138; 126/202; 126/197; 126/286; 126/288; 49/366; 49/395

[58] Field of Search ..... 126/138, 139, 123, 126, 126/140, 202, 286, 197, 288; D23/94, 138.1, 138.3; 49/319, 366, 395

[56] References Cited

U.S. PATENT DOCUMENTS

| | | | |
|---|---|---|---|
| 1,171,717 | 2/1916 | Haddox | D23/138.1 X |
| 1,832,592 | 11/1931 | Sweeley et al. | 49/319 |
| 1,919,986 | 7/1933 | Powers | 49/366 X |
| 3,459,173 | 8/1969 | Lydle . | |
| 3,870,032 | 3/1975 | Lydle et al. | 126/202 |
| 3,913,558 | 10/1975 | Caldwell . | |
| 3,995,612 | 12/1976 | Dew . | |
| 4,029,076 | 6/1977 | Simington | 126/140 |
| 4,036,205 | 7/1977 | Hayes . | |
| 4,213,446 | 7/1980 | Stookey et al. | 126/192 |
| 4,219,005 | 8/1980 | Boahn . | |
| 4,263,889 | 4/1981 | Martenson . | |
| 4,319,558 | 3/1982 | Thurlo . | |

FOREIGN PATENT DOCUMENTS

| | | | |
|---|---|---|---|
| 658 | of 1902 | United Kingdom | 126/139 |

OTHER PUBLICATIONS

Brochure: Mt. Vernon Fireplaces, Inc., "Fireplace-Furnace, A Fully Automatic Thermostatically Controlled Central Heat . . . ".

Brochure: The Welenco Fireplace Insert/Heat Exchanger.

Brochure: Welenco, Regarding the Welenco Fireplace Heat Exchanger.

*Primary Examiner*—Samuel Scott
*Assistant Examiner*—Allen J. Flanigan
*Attorney, Agent, or Firm*—Klarquist, Sparkman, Campbell, Leigh & Whinston

[57] ABSTRACT

A fireplace cap includes a pair of hinged doors supported by a rectangular framework of first and second side rails, a header section, and a damper section. The components forming the framework are formed with flanges positioned at the rear of the cap for reinforcing purposes and to act as heat exchangers, picking up heat from a fire within the fire box of the fireplace. This cap can be easily custom fit to fireplaces having fire boxes of various sizes by selecting appropriate components for the framework. A top piece mounted to the header section may serve as a cooking surface. The doors may include optional glass plates supported for easy removal by angle members mounted to the back side of the doors. A latching mechanism, including eccentrically mounted latching arms, holds the doors tightly closed when latched. The top piece and side rails define sealing material receiving pockets and include retainers for holding sealing material to seal the cap against the front of the fireplace. Adjustable damper controls, together with an external lever actuated control for the existing damper of the fireplace, are utilized to control the flow of combustion air into the fire box. A removable key or handle is provided for the latching mechanism so that it may be stored in a cool location or out of the reach of children for safety purposes.

16 Claims, 5 Drawing Figures

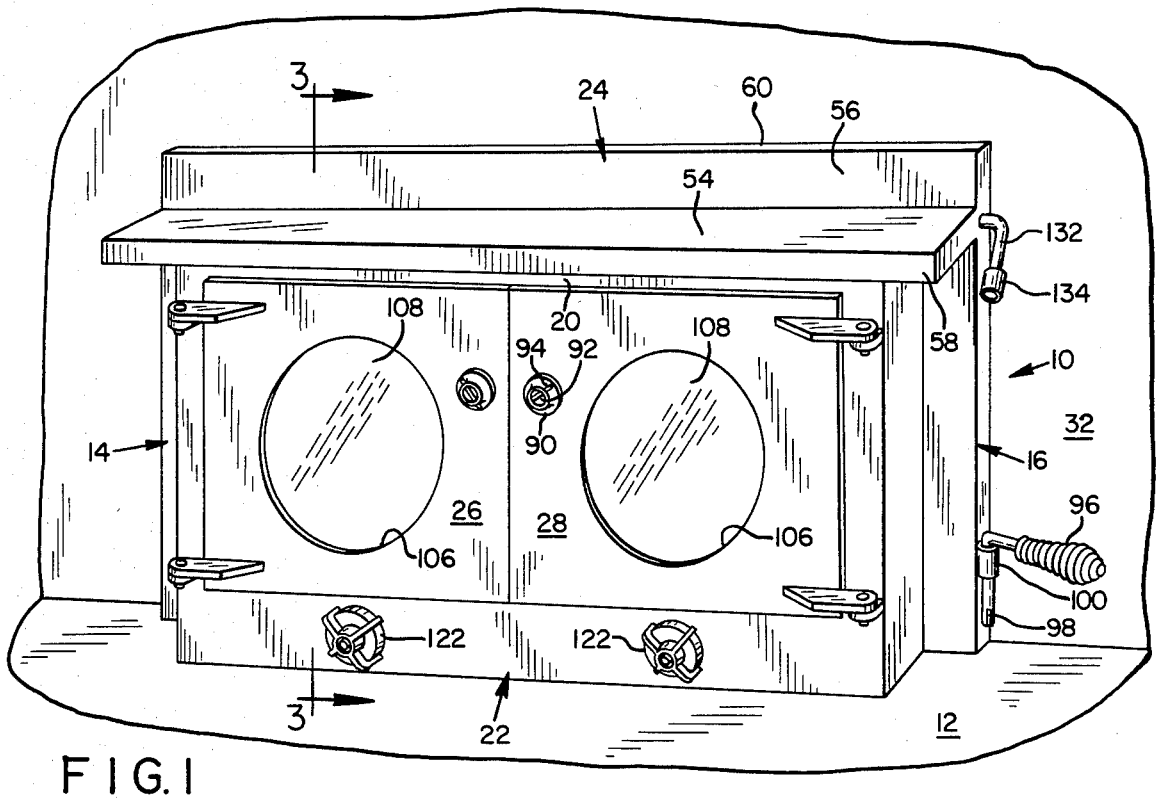
FIG. 1
FIG. 2
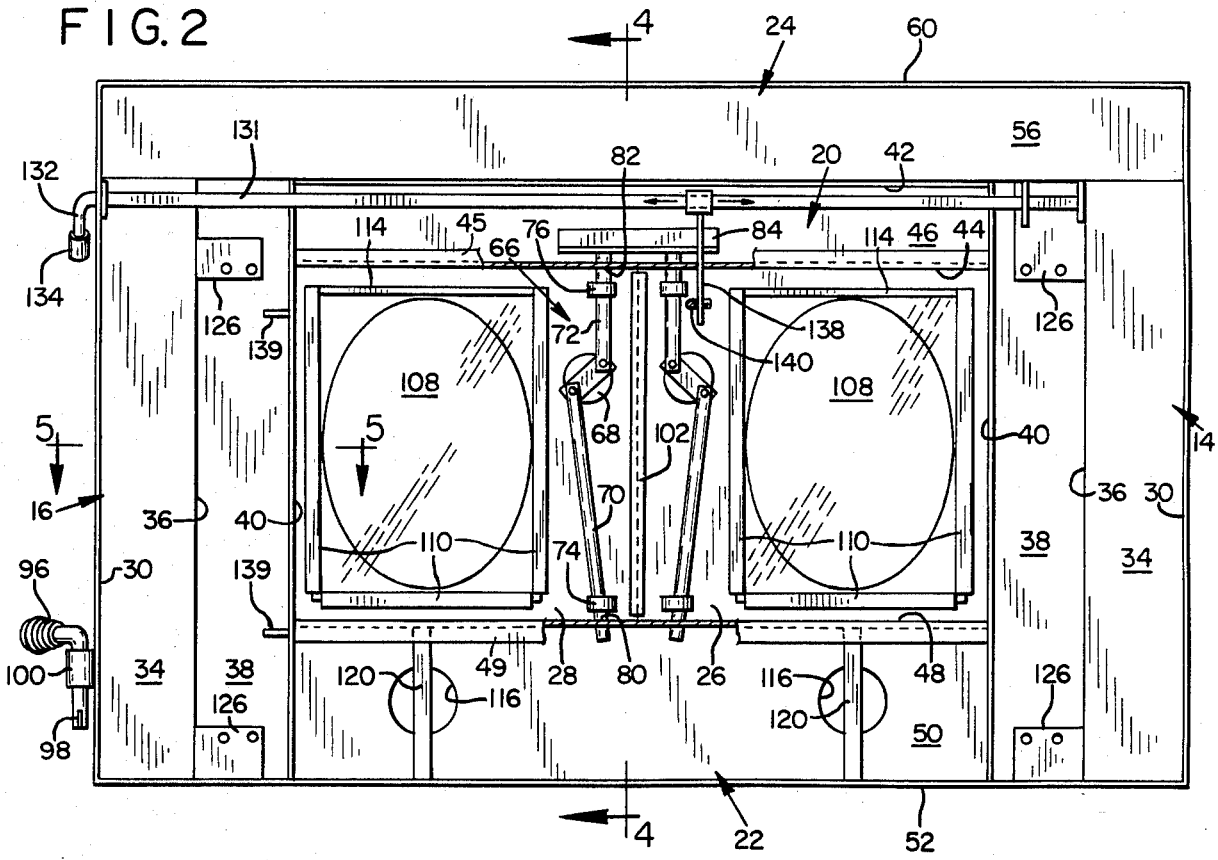

FIG. 3
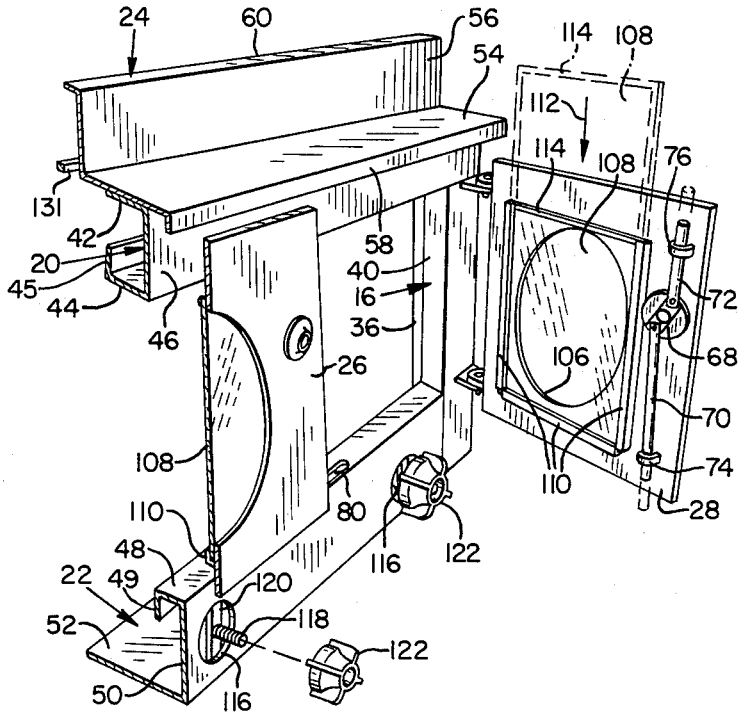
FIG. 4
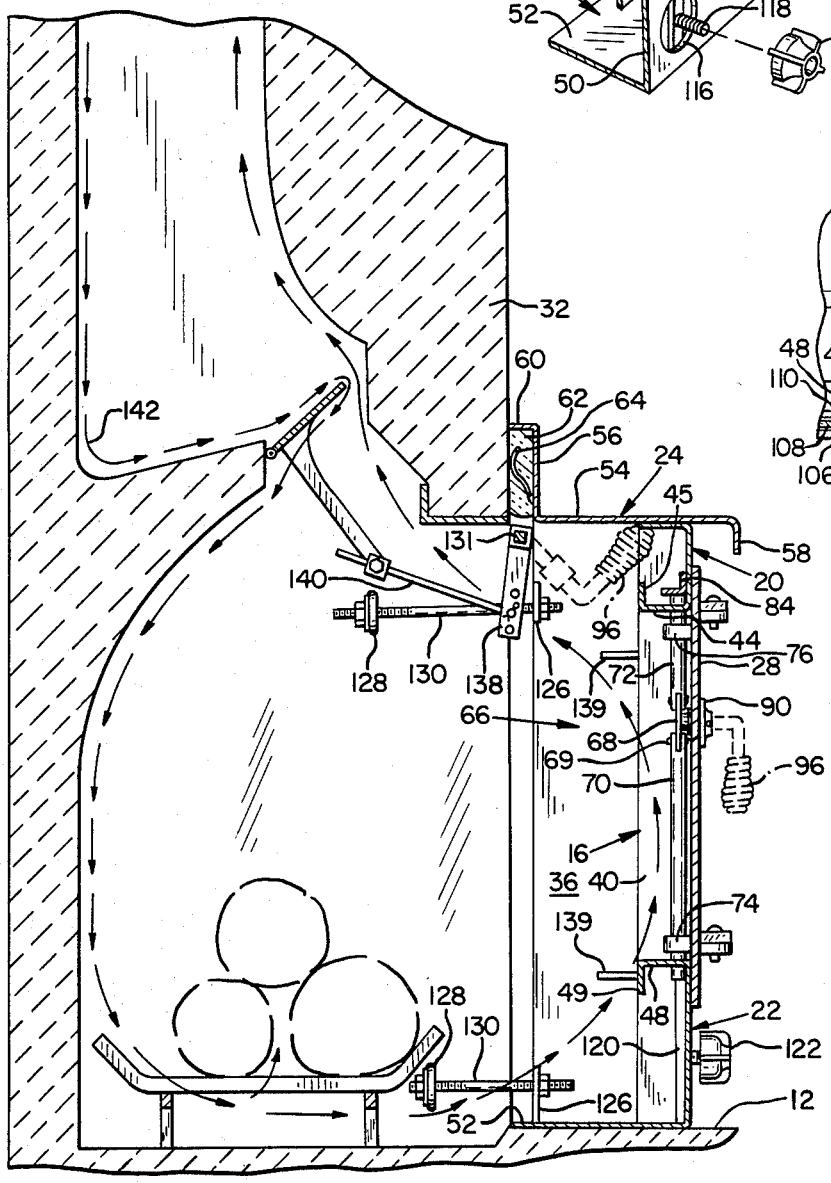
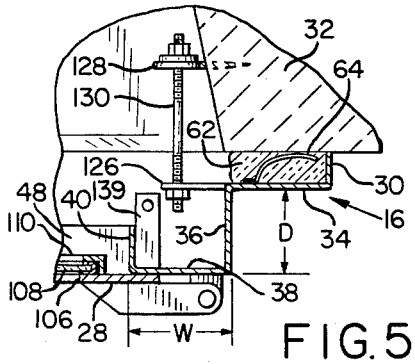
FIG. 5

FIREPLACE CAP

BACKGROUND OF THE INVENTION

The present invention relates to a front, or cap, for a fireplace.

Fireplace fronts, or caps, have heretofore been known. One such device is produced by Mt. Vernon Fireplaces, Inc., and has a flat plate for covering a fireplace opening to which a pair of hinged doors are mounted. Glass panels are included in the doors to enable the user to view the fire within the fireplace after the device is installed.

However, known fireplace caps have lacked various desirable features and advantages resulting in a need for an improved cap.

SUMMARY OF THE INVENTION

The present invention comprises a fireplace cap which is positioned outside of the fire box of a fireplace. The cap covers and seals the fireplace opening to prevent room air from entering the fireplace, except as controlled by the cap. The cap includes a pair of hinged doors mounted to a surrounding framework which includes first and second side rail members, an upper header section, and a lower damper section. These components are angular beams for reinforcing purposes and for enhancing the heat transfer characteristics of the cap.

As a more specific feature of the invention, a door latching mechanism, including latching arms eccentrically mounted to an actuator, are provided for holding the doors closed and in a substantially airtight fit.

As a further feature of the invention, this latching mechanism is adjustable to eliminate any play in the doors when closed to thereby enhance the sealing of the doors.

As another feature of the invention, a stop is provided to limit the maximum extension of the latching arms.

As still another feature of the invention, the framework components are formed, rather than welded of flat stock, to enhance their strength and facilitate manufacture of the cap.

As a further feature of the invention, a top piece is mounted to the header section and includes a cooking surface.

As still another feature of the invention, the side rail members and top piece are formed with flanges so as to define sealing material receiving pockets within which sealing material is retained by a retainer to enhance the sealing of the cap to the fireplace.

As a still further feature of the invention, a removable key or handle is provided for operating the door latching mechanism; when removed, the key may be stored in a cool location, or out of the reach of children, for safety purposes.

As another feature of the invention, the doors each include an optional window opening covered by heat-resistant transparent panels, the panels being mounted for easy removal from the fireplace doors for repairing sealing and cushioning strip surrounding the panel.

As a further feature of the invention, the doors are also removable so that they may be packed separately from the front to facilitate shipping of the cap.

As another feature of the invention, the cap includes an external lever actuated fireplace damper control for controlling the existing damper of the fireplace to thereby control the rate of combustion of fuel within the fireplace.

As a still further feature of the invention, adjustable damper knobs on the front of the cap are provided for controlling the flow of initial combustion air into the fire box of the fireplace.

It is an overall object of the invention to provide an approved fireplace cap.

It is another object of the invention to provide a fireplace cap which is efficient in recovering heat from fuel burned within the fireplace and in controlling the combustion of fuel within the fire box.

A further object of the invention is to provide a cap which may be easily custom manufactured to fit the varying dimensions of fireplace openings with a minimum inventory of parts required for such custom manufacture.

A still further object of the invention is to provide a fireplace cap which is strong and durable.

Another object of the invention is to provide a fireplace cap which is safe to use.

Still another object of the invention is to provide a fireplace cap which is easy to install, clean, and which is virtually maintenance-free.

A further object of the invention is to provide a fireplace cap which enhances the functioning of an existing fireplace.

These and other objects, advantages, and features of the invention will become apparent with reference to the following description and drawings.

BRIEF DESCRIPTION OF THE DRAWINGS

FIG. 1 is a front perspective view of a fireplace cap in accordance with the invention;

FIG. 2 is a back elevational view of a fireplace cap in accordance with the invention;

FIG. 3 is a front perspective view of the fireplace cap of FIG. 1, partially in section, taken along line 3—3 of FIG. 1;

FIG. 4 is a cross sectional view of an installed fireplace cap in accordance with the invention, taken along line 4—4 of FIG. 2; and FIG. 5 is a cross sectional view through a side rail member of the fireplace cap of the invention, taken along line 5—5 of FIG. 2.

DETAILED DESCRIPTION OF THE PREFERRED EMBODIMENT

With reference to FIG. 1, a fireplace cap 10, in accordance with the invention, is positioned on a hearth 12 outside of the fire box of a conventional masonry, heatalator or other fireplace. Thus, the entire fire box is unobstructed by the cap and is available for use in burning fuel.

As best seen in FIGS. 2 and 3, cap 10 includes a rectangular framework formed of four major components, including upright side rails 14, 16, a header section 20 interconnecting the upper ends of the side rails, and a damper section 22 interconnecting the lower ends of the side rails. These components define a fireplace cap opening through which access to the fire box is provided. An elongated top piece 24 overlies the header. The side rails 14, 16, header section 20, and damper section 22 are preferably of a strong, durable heat-conducting material, such as of a heavy gauge steel which is formed or bent into angular shape. In comparison to flat stock, this manner of manufacture reduces the amount of welding required because only four weld seams are needed to join these members. The elimination of welds adds extra strength to the cap. A pair of doors 26, 28 are hinged to the respective side rails 14, 16, for selective access to the interior of the fire box of the fireplace.

More specifically, these components of the framework will next be described in greater detail. The side rails 14, 16 have an identical cross section as shown in FIG. 5. More specifically, side rail 16 includes a first upright flange portion 30. This flange 30 is laterally spaced from the fireplace opening and extends outwardly away from the masonry 32 of the fireplace, with an upright edge of the flange abutting the masonry when the cap is installed. The side rail 16 bends through a ninety-degree angle from flange 30 to form a first step 34. This step 34 parallels the masonry and, together with flange 30, forms a sealing material receiving pocket in which heat-resistant fiber or other material 62 is positioned to seal the gap between the side rail and fireplace. Retainers, such as plural wires 64, spot-welded or otherwise mounted to the back side and along the length of step 34, impale the sealing material and hold it in place. From step 34, the side rail turns outwardly through a ninety-degree angle to a riser portion 36 of a width or depth D. The riser portion parallels the first flange 30. From riser portion 36, the rail bends inwardly through an additional ninety-degree angle to form a second step 38 having a width W. This second step covers a portion of the fireplace opening. Finally, the side rail bends through still another ninety-degree angle and terminates in a reinforcing flange or rib 40 which extends toward the fireplace. This flange bounds the side margins of the cap opening.

The header section 20 comprises a channel with respective upper and lower horizontal header section legs 42, 44, a vertical reinforcing flange 45 projecting upwardly from header section leg 44, and a vertical header section face 46. In addition, the damper section 22 is also generally channel-shaped with an upper horizontal damper section leg 48, a vertical reinforcing flange 49 projecting downwardly from damper section leg 48, a vertical damper section face 50, and a lower horizontal damper section leg 52. Leg 52 may be of one piece or comprise a flange of the same width as damper section leg 48, to which a filler plate is welded. The lower damper section leg 52 is relatively wide to provide a broad base for supporting the cap. Sealing material (not shown) may be placed under leg 52 for sealing purposes. Header section leg 44 bounds the upper margin of the cap opening while damper section leg 48 bounds the lower margin of the cap opening. Therefore, a continuous rib including the side rail flanges 40 and legs 44, 48 surrounds and reinforces the cap opening. Reinforcing is also provided by the flanges 45, 49.

In addition, the top piece 24 is of right-angular construction, with a horizontal cooking shelf portion 54 and a vertical back portion 56. A down-turned flange 58 is provided along the front edge of the shelf 54 while a rearward extending flange 60 is positioned along the upper edge of the back section 56. Flange 60 abuts the fireplace masonry above the fireplace opening. As best seen in FIG. 4, back section 56 and flange 60 define a sealing material receiving pocket within which sealing material 62 is retained to seal the top of the cap.

With components shaped as described above, the construction of the cap is more efficient, economical, and requires a minimum inventory of components to custom manufacture caps for fireplaces with various sized fireplace openings. That is, the doors 26, 28 are a standard size for all caps so that only one door size is required. In addition, side rails are inventoried with varying depths D and widths W, together with top pieces 24, header sections 20, and damper sections 22 of appropriate lengths. Consequently, given the dimensions of a fireplace opening, the desired components may be readily selected and assembled to fit the customer's fireplace.

The strength of the unit is enhanced, due to the rigid angular construction of the components. The heat transfer characteristics of the cap are also improved due to the light gauge metal utilized in the preferred embodiment. Also, the cap is more efficient in recovering heat from fuel burned in the fire box because of the various ribs and flanges which project from the back side of the cap toward the fire box. These ribs and flanges absorb heat from the fire, resulting in increased heat being radiated into the room from the burning fuel. Also, heat from the fire is stored in the mass of the fireplace masonry and radiated into the room containing the fireplace.

A special latching mechanism 66 is provided to tightly seal and hold the doors 26, 28 closed. An identical mechanism is provided for each door and will be described for door 28, with reference to FIGS. 2 and 4. The latching mechanism 66 includes an actuator having a plate 68 pivoted by a pin 69 to the door 28. Respective upper and lower latching arms 70, 72 are eccentrically and pivotally mounted to the plate 68. The lower arm 70 extends through a cylindrical guide 74 mounted to the back side of the door while the upper arm 72 extends through a similar guide 76. When the doors are latched as shown in FIG. 2, the arm 70 extends through an opening 80 in the damper section leg 48. At the same time, upper arm 72 extends through an opening 82 in the header section leg 44. A stop 84 is mounted to the back of the header section face 46. This stop engages the arm 72 and limits the maximum extension of the latching arms to prevent over-centering and binding of the latching mechanism.

The actuator also includes a front actuator portion 90 (FIGS. 1 and 4) mounted to pin 69 at the front side of the door 28. In the preferred embodiment, actuator portion 90 comprises a disc with a bore 92, across which a pin 94 extends. A removable key or handle 96, having a slot 98, is utilized to operate actuator portion 90 and the latching mechanism. That is, the handle 96 is positioned with the pin 92 in the slot 98 and then pivoted in one direction to retract the latching arms to permit the doors to open. The handle is pivoted in the opposite direction to extend the latching arms to hold the doors closed. When not in use, the handle is inserted within a cylindrical sleeve 100 mounted to side rail 16 where it will not get hot. In addition, the handle may be placed in a hard-to-reach location so that children cannot use the handle to open the doors when a fire is burning.

With this door closure mechanism, the doors are tightly sealed when closed. The guides 74, 76 may be bent to eliminate any free play in the doors when latched. This adjustment feature helps insure a tight fit of the doors when closed. Also, a vertical lip is provided by a strip 102 mounted to the free edge of door 26. This lip bears against the door 28 when the doors are closed to seal the crack between the doors.

In addition, optional window openings 106 may be provided in the respective doors 26, 28. A transparent heat-resistant panel or pane, such as ceramic glass, covers the openings 106 so that fire within the fire box may be viewed. As shown in FIG. 3, right angular members 110 are mounted to the inside of the doors along the respective sides and bottom of the window opening 106. The glass is then slid downwardly, in the direction of arrow 112, into slots defined by these angled members, so that the panel is held in place. The panel can easily be removed by lifting it upwardly for repair purposes. In addition, a heat-resistant material, such as woven fiberglass 114, is adhesively secured to the four edges of the glass. This provides an airtight seal and cushion between the glass and door.

A pair of damper openings 116 (FIG. 3) are provided through the damper face section 50 of the damper section 22. A threaded bolt 118 projects outwardly through these openings 116 from a bar welded to the inside of the damper face section. A damper control knob 122 is mounted to the bolt 118. Control knob 122 is rotated to close the opening 116 completely, or to open it, as desired.

For installation purposes, brackets 126 (see FIG. 2) are mounted to the framework of the cap. Eye bolts 128 are lagged into the masonry or steel at the inside of the fire box of the fireplace. Threaded rods 130 extend through the brackets 126 and eye bolts 128. Nuts on the rods 130 are then tightened to draw the cap snugly against the front of the fireplace.

The apparatus also includes an external control for operating a conventional damper of the fireplace. With reference to FIGS. 1 and 2, this control comprises a rod with a first horizontal section 131 passing through side rail 16, positioned above the doors 26, 28, and pivotally mounted to the framework. The rod section 131 is bent where it emerges from the cap to form a lever section 132 which terminates in a socket 134. The socket 134 is adapted to receive the handle 96 for operating the lever to rotate the rod. A damper actuating arm 138 is slidably mounted to rod section 134 and projects outwardly therefrom. An elongated rod 140 (FIG. 4) is utilized to couple the actuating arm 138 to the fireplace damper. When the lever section 132 is pivoted, rod section 131 and actuating arm 138 pivot to open and close the damper.

Typically, when a fire is first lit within the fireplace, the damper knobs 122 are opened substantially to allow combustion air from the room to enter the fireplace. However, after the fire is burning, the knobs 122 are rotated to close off the damper openings. In addition, the fireplace damper is operated to close it almost entirely. Because of the tightness of the seal between the cap and the fireplace, little or no combustion air enters the fireplace from the room. Preliminary studies indicate that, under such conditions, combustion air, indicated by arrows 142, moves downwardly along the back side of the fireplace flue and into the fire box. Air currents established within the fire box sweep heated air within the fire box and toward the front of the cap, thereby enhancing its heating efficiency.

Because the damper control is operable from the outside of the fire box, the fireplace damper may be shut in the event of a flue fire to help put it out. Also, fire within the fire box will go out, without smoke entering the room, because of the tight seal between the cap and front of the fireplace.

Brackets 139 may be welded to one or both of the ribs 40 for supporting barbeque grills, pots, and the like within the fireplace. Thus, in conjunction with the cooking surface 54 of the top piece 24, the cap may function as a cook stove and barbeque, as desired.

Having illustrated and described the principles of my invention with reference to one preferred embodiment, it should be apparent to those persons skilled in the art that such invention may be modified in arrangement and detail without departing from such principles. I claim as my invention all such modifications as come within the true spirit and scope of the following claims.

I claim:

1. A fireplace cap for a fireplace with a fire box and fireplace opening leading to the fire box comprising:

an upright, rectangular frame means including first and second plural stepped side rail members, a lower damper section, and an upper header section, said frame means defining a fireplace cap opening and being adapted for mounting to the front of a fireplace so as to permit insertion of fuel through the cap and fireplace openings and into the fire box of the fireplace, each of said side rail members including a first step adjacent to the fireplace opening and a second step adjacent to the first step, the first step being of shallower depth than the second step;

at least one hinged door mounted to said frame means and movable from a first position closing the cap opening to second positions opening the cap opening; and latching means for holding said door in a closed position.

2. A fireplace cap according to claim 1 in which said frame means includes a rib surrounding the cap opening, the rib projecting inwardly toward the fire box of the fireplace when the cap is installed.

3. A fireplace cap for a fireplace with a fire box and fireplace opening leading to the fire box comprising:

an upright, rectangular frame means including first and second plural stepped side rail members, a lower damper section, and an upper header section, said frame means defining a fireplace cap opening and being adapted for mounting to the front of a fireplace so as to permit insertion of fuel through the cap and fireplace openings and into the fire box of the fireplace;

at least one hinged door mounted to said frame means and movable from a first position closing the cap opening to second positions opening the cap opening;

latching means for holding said door in a closed position;

said side rail members are each formed with a first flange portion, a first step portion, a riser portion, a second step portion, and a rib portion, the first flange portion having an upright edge adapted to abut the front of the fireplace at a location spaced laterally from the fireplace opening when the cap is installed, the first step portion being spaced from the fireplace and extending from the first flange portion such that the first flange portion and first step portion together define a sealing material receiving pocket along the side of the cap, the riser portion projecting outwardly from the first step portion and being spaced from the first flange portion, the second step portion extending from the riser portion and covering a portion of the fireplace opening, and the rib portion extending inwardly from the riser portion and bounding the side margin of the cap opening;

the header section comprising a channel having an upper header leg section, a header face section, and a lower header leg section, the lower leg section bounding the upper margin of the cap opening;

the damper section also being channel-like, with an upper damper leg section, a damper face section, and a damper lower leg section, the damper upper leg section bounding the lower margin of the cap opening; and said cap including a top member, said top member including a flat surface portion mounted to the head upper leg section, an upright back portion spaced from the fireplace and extending upwardly from the inner edge of the flat surface portion, and a top flange portion extending from the back portion with its free edge abutting the fireplace at a location above the fireplace opening, the back portion and top flange portion together defining a sealing material receiving pocket along the top of the cap.

4. A fireplace cap according to claim 3 including retainer means mounted to the back surface of the back portion and to the back surface of the first step portion for retaining sealing material within the respective sealing material receiving pockets.

5. A fireplace cap for a fireplace with a damper, a fire box, and a fireplace opening leading to the fire box comprising:

an upright, rectangular frame means including first and second side rail members, a lower damper section, and an upper header section, said frame means defining a fireplace cap opening and being adapted for mounting to the front of the fireplace so as to permit insertion of fuel through the cap and fireplace openings and into the fire box of the fireplace;

at least one hinged door mounted to said frame means and movable from a first position closing the cap opening to a second position opening the cap opening; and latching means for holding said door in a closed position, said latching means including actuator means pivotally mounted to said door at a location above the center of the door, a first latching arm means eccentrically mounted to said actuator means and extending upwardly therefrom, a second latching arm means eccentrically mounted to said actuator means and extending downwardly therefrom, said second latching arm means being longer than said first latching arm means first guide means for receiving and guiding the motion of said first latching arm means, second guide means for receiving and guiding the motion of said second latching arm means, said header section defining an upper latching arm receiving opening, said damper section defining a lower latching arm receiving opening; and handle means for pivoting said actuator means in a first direction to extend said first latching arm means into the upper latching arm receiving opening and said second latching arm means into the lower latching arm receiving opening so as to latch the door in a closed position, and for pivoting the latching arms in a second direction to retract the latching arms from the respective latching arm receiving opening and permit the door to open.

6. A fireplace cap according to claim 5 including at least two of said doors, one of said latching means being provided for each door, the fireplace cap including stop means for engaging at least one of the said first and second latching arm means of each of the latching means for limiting the maximum extension of said first and second latching arm means.

7. A fireplace cap according to claim 5 in which said first and second guide means are adjustable to tighten the seal of the door against the frame means.

8. An apparatus according to claim 5 in which said door defines a window opening, said fireplace cap including a window panel for closing the window opening and means for removably mounting the window panel to the door, said last named means comprising angle members mounted to the back surface of the doors along the sides and bottom of the window opening, such that the window panel is insertable and removable from above into channels defined by the angle members and back side of the door, and in which cushioning and sealing material is positioned between the peripheral edges of the window panel and channels.

9. A fireplace cap for a fireplace with a fire box, a fireplace opening leading to the fire box, and a fireplace damper comprising:

an upright, rectangular frame means including first and second side members, a lower damper section, and an upper header section, said frame means defining a fireplace cap opening and being adapted for mounting to the front of a fireplace so as to permit insertion of fuel through the cap and fireplace openings and into the fire box of the fireplace;

at least one hinged door mounted to said frame means and movable from a first position closing the cap opening to second positions opening the cap opening;

latching means for holding said door in a closed position; and including fireplace damper control means mounted to said fireplace cap for lateral shifting between the side rails to a position in alignment with the existing damper of the fireplace, said damper control means comprising means for coupling to and operating the existing damper of the fireplace.

10. A fireplace cap for a fireplace with a fire box, a fireplace opening leading to the fire box, and a fireplace damper comprising:

an upright, rectangular frame means including first and second side members, a lower damper section, and an upper header section, said frame means defining a fireplace cap opening and being adapted for mounting to the front of a fireplace so as to permit insertion of fuel through the cap and fireplace openings and into the fire box of the fireplace at least one hinged door mounted to said frame means and movable from a first position closing the cap opening to second positions opeing the cap opening;

latching means for holding said door in a closed position; and including a damper control rod pivotally mounted to the fireplace cap, said damper control rod including a first rod section extending through one of the side members and positioned above the fireplace cap opening, said damper control rod also including a second lever section positioned outside of the fireplace cap, said damper control means including a damper actuating arm means slidably non-rotatably mounted to said first rod section so as to be movable along the first rod section into a position aligned with the existing fireplace damper, and means for coupling the damper actuating arm means to the fireplace damper, such that pivoting the second lever section pivots the first rod section and damper actuating arm means to thereby control the fireplace damper.

11. A fireplace cap according to claim 10 in which said damper section includes damper openings and damper closure means for opening and closing the damper openings, said fireplace damper control means and damper closure means controlling the flow of combustion air into the fire box of the fireplace.

12. A fireplace cap for a fireplace with a damper, a fire box, and a fireplace opening leading to the fire box comprising:

an upright, rectangular, frame means including first and second side rail members, a lower damper section, and an upper header section, said frame means defining a fireplace cap opening and being adapted for mounting to the front of the fireplace so as to permit insertion of fuel through the cap and fireplace opening and into the fire box of the fireplace;

said side rail members each being formed with a first flange portion, a first step portion, a riser portion, a second step portion, and a rib portion, the first flange portion having an upright edge adapted to abut the front of the fireplace at a location spaced laterally from the fireplace opening when the cap is installed, the first step portion being spaced from the fireplace and extending from the first flange portion, such that first flange portion and the first step portion together define a sealing material receiving pocket along the side of the cap, the riser portion projection outwardly from the first step portion and being spaced from the first flange portion, the second step portion extending from the riser portion and covering a portion of the fireplace opening, and the rib portion extending inwardly from the riser portion and bounding the side margin of the cap opening;

the header section comprising a channel having an upper header leg section, a header face section, and a lower header leg section, the lower leg section bounding the upper margin of the cap opening;

the damper section also being channel-like with an upper damper leg section, a damper face section, and a damper lower leg section, the damper upper leg section bounding the lower margin of the cap opening, the damper lower leg section being wider than the damper upper leg section so as to provide a broad support for the cap on the hearth of a fireplace;

a top member including a flat cooking surface portion mounted to the header upper leg section, and upright back portion spaced from the fireplace and extending upwardly from the inner edge of the cooking shelf portion, a top flange portion extending from the back portion with its free edge abutting the fireplace at a location above the fireplace opening, the back portion and top flange portion together defining a sealing material receiving pocket along the top of the cap;

retainer means mounted to the back surface of the back portion and to the back surface of the first step portion, for retaining sealing material within the respective sealing material receiving pocket;

a pair of hinged doors mounted to said frame means and movable from first positions closing the cap opening to second positions opening the cap opening;

a separate latching means associated with each of said doors for holding the associated door in a closed position, each said latching means including actuator means pivotally mounted to said door, a first latching arm means eccentrically mounted to said actuator means and extending upwardly therefrom, a second latching arm means eccentrically mounted to said actuator means and extending downwardly therefrom, first guide means for receiving and guiding the motion of said first latching arm means, second guide means for receiving and guiding the motions of the second latching arm means, said header section defining an upper latching arm receiving opening;

handle means for pivoting said actuator means in a first direction to extend said first latching arm means into the upper latching arm receiving opening and said second latching arm means into the lower latching arm receiving opening so as to latch the door in a closed position, and for pivoting the latching arms in a second direction to retract the latching arms from the respective latching arm receiving openings and to permit the door to open, said handle being removable so as to be storable at a cool location or a location out of the reach of children;

fireplace damper control means for coupling to and operating the existing damper of the fireplace, said damper control means including a damper control rod pivotally mounted to the fireplace cap, said damper control rod including a first rod section extending through one of the side rail members and positioned above the fireplace opening, said damper control rod also including a second lever section positioned outside of the fireplace cap, said damper control means including a damper actuating arm means slidably and non-rotatably mounted to said first rod section so as to be movable along the first rod section into a position aligned with the fireplace damper, and means for coupling the damper actuating arm means to the fireplace damper, such that pivoting the second lever section pivots the first rod section and damper actuating arm means to thereby control the fireplace damper; and said damper section including at least one damper opening and damper closure means for opening and closing the damper opening, said fireplace damper control means and damper closure means controlling the flow of combustion air into the fire box of the fireplace.

13. A fireplace cap according to claim 10 in which said means for coupling the damper actuating arm means to the fireplace damper comprises a second rod section having first and second end portions, said second rod section being pivotally connected at its first end portion to said actuating arm means, damper connection means mounted to the existing fireplace damper and slidably connected to the second end portion of said second rod section so as to permit relative sliding of the damper connection means and second end portion, and clamping means for selectively preventing the relative sliding of the damper connection means and second end portion, whereby the damper connection means and clamping means cooperate to permit adjustment of the damper control means and adjustment of the degree of opening and closing of the existing fireplace damper in response to pivoting of the first rod section.

14. A fireplace cap according to claim 5 in which each of said first and second latching arm means comprises a rod provided with a slot at the end of the rod adjacent to said actuator means, said actuator means being sized for insertion into the slot and being pivoted to the rod when so inserted to thereby connect the first and second latching arm means to the actuator means.

15. A fireplace cap according to claim 5 in which said handle is removably attached to said actuator means, said fireplace cap including handle storing means mounted to said frame means for storing the handle when removed from the door.

16. A fireplace cap according to claim 5 in which said actuator means includes an actuator portion having an orifice accessible from the front side of the door, the actuator portion being coupled to the first and second latching arm means such that pivoting of the actuator portion moves the latching arm means to latch and unlatch the door;

the handle being insertable and removable from the orifice, said actuator portion including engagement means within the orifice which is loosely engaged by the handle upon insertion of the handle into the orifice such that, when engaged, pivoting the handle pivots the actuator means to thereby move the latching arm means.

* * * * *

UNITED STATES PATENT AND TRADEMARK OFFICE

CERTIFICATE OF CORRECTION

PATENT NO. 4,508,098

DATED : April 2, 1985

INVENTOR(S) : Philip E. Scheler

It is certified that error appears in the above-identified patent and that said Letters Patent is hereby corrected as shown below:

Claim 10, line 56, column 8, "opeing" should be --opening--.

Claim 10, line 60, column 8, before "including" insert -damper control means--.

Signed and Sealed this

*Twentieth* Day of *August 1985*

[SEAL]

*Attest:*

DONALD J. QUIGG

*Attesting Officer*

*Acting Commissioner of Patents and Trademarks*